US008157137B1

(12) United States Patent
Laird

(10) Patent No.: US 8,157,137 B1
(45) Date of Patent: Apr. 17, 2012

(54) PERSONAL EATING TRAY

(76) Inventor: Robert Laird, Wapwallopen, PA (US)

( * ) Notice: Subject to any disclaimer, the term of this patent is extended or adjusted under 35 U.S.C. 154(b) by 297 days.

(21) Appl. No.: 12/712,317

(22) Filed: Feb. 25, 2010

(51) Int. Cl.
*A45F 5/00* (2006.01)

(52) U.S. Cl. ..... 224/258; 224/270; 108/43

(58) Field of Classification Search ..... 224/201, 224/600, 607, 614, 623, 625, 257, 258, 265, 224/270; 108/43
See application file for complete search history.

(56) References Cited

U.S. PATENT DOCUMENTS

| | | | | |
|---|---|---|---|---|
| 452,490 | A | 6/1891 | Kropp | |
| 2,995,281 | A * | 8/1961 | Dixon | 224/148.4 |
| 4,114,199 | A | 9/1978 | Malan | |
| 4,770,107 | A | 9/1988 | Miller | |
| 4,887,315 | A | 12/1989 | Bezdek | |
| 4,915,278 | A | 4/1990 | Smith | |
| 4,985,932 | A | 1/1991 | Bezdek | |
| 5,046,433 | A * | 9/1991 | Kramer et al. | 108/44 |
| 5,062,558 | A | 11/1991 | Stang | |
| 5,443,018 | A | 8/1995 | Cromwell | |
| 5,551,615 | A | 9/1996 | McIntosh | |
| 5,724,225 | A * | 3/1998 | Hrusoff et al. | 361/679.55 |
| 7,806,305 | B1 * | 10/2010 | Moore et al. | 224/265 |
| 2006/0037987 | A1 * | 2/2006 | Lin | 224/646 |

* cited by examiner

*Primary Examiner* — Justin Larson
(74) *Attorney, Agent, or Firm* — Montgomery Patent & Design, LLC; Robert C. Montgomery; Joseph T. Yaksich

(57) ABSTRACT

A neck-mounted personal eating apparatus designed to facilitate eating by a person away from a table, is herein disclosed. The apparatus comprises a rectangular tray equipped with a raised lip around the entire perimeter to prevent liquid spills or loss of crumbs. The short side edges of the tray are provided with an adjustable padded neck strap which goes up and around the rear neck area of the user and attaches to the opposite sides of the tray. The neck strap comprises a flexible plastic "U"-shape strap having a plurality of holes to allow for adjustment. The holes connect to molded ball-end appendages located on either side of the tray. In such a manner, the neck strap can be easily resized to suit all size users from large adults to small children. Additionally, the apparatus comprises an angled fixed length strap that connects to the neck strap to help keep the tray level and prevent movement during use.

16 Claims, 3 Drawing Sheets

PERSONAL EATING TRAY

RELATED APPLICATIONS

The present invention was first described in a notarized Official Record of Invention on Mar. 16, 2009, that is on file at the offices of Montgomery Patent and Design, LLC, the entire disclosures of which are incorporated herein by reference.

FIELD OF THE INVENTION

The present invention relates generally to eating surfaces, and in particular, to a portable personal tray which provides a stabile eating surface which is easily adaptable to a number of unconventional locations.

BACKGROUND OF THE INVENTION

In the modern world, the establishment of organized dining occupies a niche much different than its traditional role. While previously a daily ritual, in many modern lives and families, sit-down meals are more of an occasional luxury. This fact can be attested to by the pervasiveness of fast food restaurants and the like. Many persons, especially those in the working class, spend much of their time running errands, traveling, and the like. As a result, many meals are consumed away from the traditional comforts of a home dining room.

Despite the frequency with which away-from-home meals occur today, it is often difficult to manage the consumption of the meals when without access to a conventional table or the like. Food is consumed while walking, while in a car, while outdoors, and in other difficult scenarios. Conventional eating means are not available in such situations, and attempting to eat the meal without a surface often leads to spills, stains, dropped food, and a lack of proper enjoyment of the meal.

Various attempts have been made to provide an eating surface for use in unconventional locations. Examples of these attempts can be seen by reference to several U.S. patents. U.S. Pat. No. 4,770,107, issued in the name of Miller, describes a portable travel tray. The Miller device is mounted on the rear side of a conventional vehicle seat to provide a flat surface to a passenger seated behind the tray.

U.S. Pat. No. 4,985,932, issued in the name of Bezdek, describes a food spill catching and serving device. The Bezdek device comprises a tray with an integral strap which helps a user to carry a plurality of food or beverage items or the like with dropping them.

U.S. Pat. No. 5,062,558, issued in the name of Stang, describes a food tray and bib system. The Stang device comprises a bib with a large cavity in a lower portion capable of receiving a tray.

While these devices fulfill their respective, particular objectives, each of these references suffer from one (1) or more of the aforementioned disadvantages. Many such devices are not easily portable or adaptable to all locations. Also, many such devices are not easily washable or are not reusable. Furthermore, many such devices are not adjustable in both height and angle to suit a variety of users and situations. In addition, many such devices do not provide a flat, stabilized surface which reasonably approximates a traditional eating surface while still providing a lip for the containment of spills and the like. Accordingly, there exists a need for a personal eating tray without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to allow a user to consume both food and beverages in a stabile manner while away from traditional eating surfaces, in a manner which is easily portable and easily adjustable. Thus, the object of the present invention is to solve the aforementioned disadvantages and provide for this need.

To achieve the above objectives, it is an object of the present invention to comprise a rectangular tray made of an easily washable food-grade plastic. The tray further comprises an upwardly extending lip located around the entire perimeter edge of the tray. The lip assists in preventing liquid spills, loss of crumbs, and the like.

Another object of the present invention is for the short side edge portions of the tray to provide an attachment means for an adjustable neck strap. In use, the strap goes up and around the neck of the user.

Yet still another object of the present invention is to comprise the neck strap of a "U"-shaped flexible plastic strap which further comprising a plurality of equally spaced apertures. The apertures allow connection of the adjustable strap to the side surfaces of the tray via corresponding connectors.

Yet still another object of the present invention is to comprise a pair of angled fixed length straps which help to keep the tray level and prevent movement during use. The fixed length straps attach to the two (2) end portions of the neck strap as well as short side portions of the tray.

Yet still another object of the present invention is to comprise a plurality of integrally molded connectors located along opposing side surfaces of the tray at intermediate and rear positions. The connectors comprise latching appendages which allow a user to selectively secure the adjustable strap at one of its apertures, providing a height adjusting and leveling means. In a preferred embodiment, the connectors comprise a ball-end fastening feature to provide an interference fit when inserted through the apertures.

Yet still another object of the present invention is to further comprise an adjustable strap of a neck pad which provides a comfortable surface against a user's neck during use. In a preferred embodiment, the neck pad comprises a laterally stationary cylindrical portion of foam with a smooth plastic covering.

Yet still another object of the present invention is to comprise indicia being molded or painted onto the top surface of the tray. The indicia provide script or logos based upon a user's preference and further comprise a variety of corresponding colors and patterns.

Yet still another object of the present invention is to comprise a pair of dog bone-shaped fasteners which provide an interference fit in order to securely connect the top end of each fixed length strap with a selected aperture of the adjustable strap in order to provide a leveling and angle adjustment means.

Yet still another object of the present invention is to provide a method of utilizing the device that provides a unique means of easily transporting the device, adjusting the height and angle in a simple manner to provide a stabile and comfortable surface for a particularly sized user in a particular location, placing the device over the user's neck in a comfortable manner, eating and drinking from the tray, easily removing and collapsing the tray for transport, and easily washing the tray for reuse.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
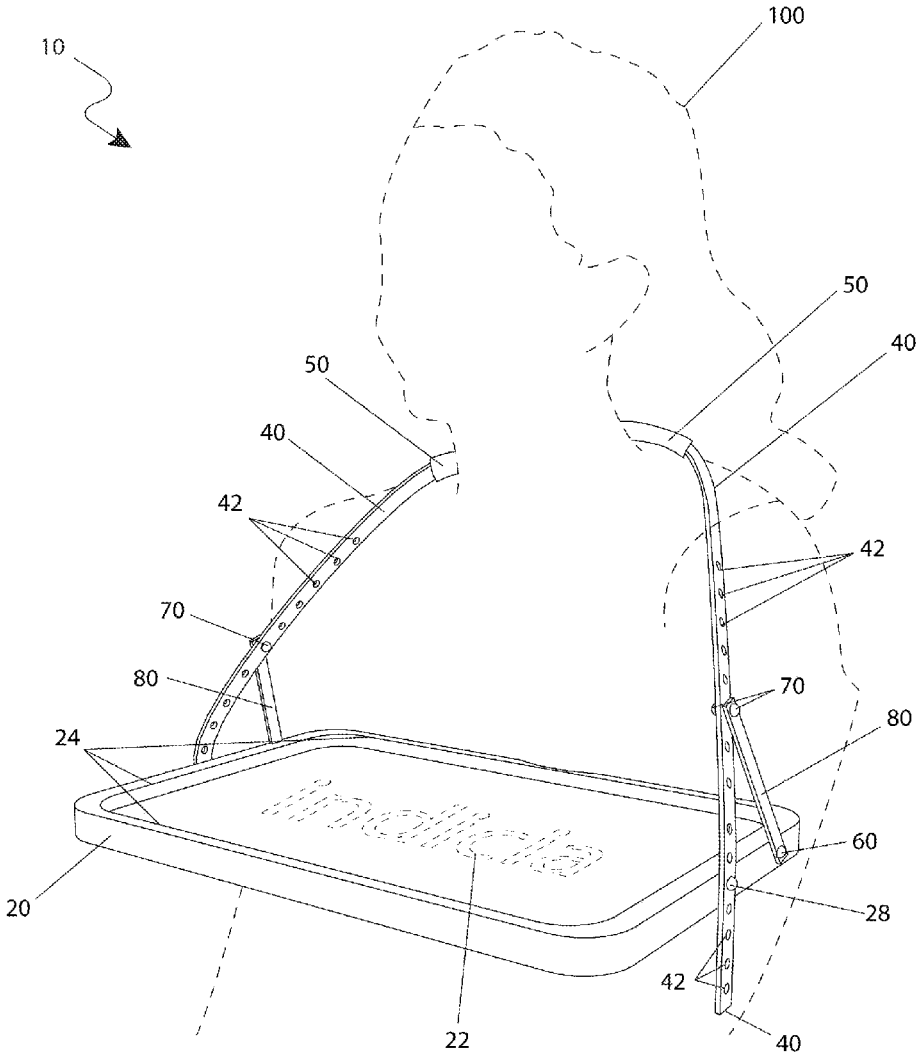
FIG. 1 is a perspective view of a personal eating tray 10 depicting an in-use state, according to a preferred embodiment of the present invention.

10 personal eating tray
20 tray
22 top surface
24 lip portion
26 indicia
28 first connector
40 adjustable strap
42 strap aperture
50 neck pad
60 second connector
70 third connector
80 fixed length strap
100 user

DETAILED DESCRIPTION OF THE PREFERRED EMBODIMENT

Figure 3B:
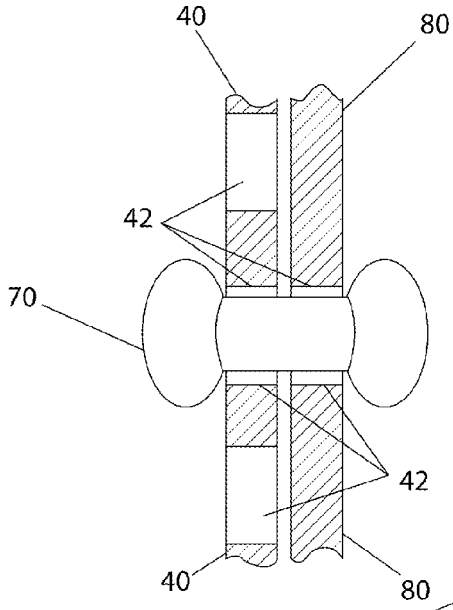
FIG. 3*a* is a close-up view of first 28 and second 60 connector portions of the personal eating tray 10, according to a preferred embodiment of the present invention; and, FIG. 3*b* is a close-up view of a third connector portion 70 of the personal eating tray 10, according to a preferred embodiment of the present invention.

The best mode for carrying out the invention is presented in terms of its preferred embodiment, herein depicted within FIGS. 1 and 3*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a personal eating tray (herein described as the "apparatus") 10, which provides a neck-mounted personal eating device designed to facilitate eating by a user 100 away from a table. The apparatus 10 comprises a rectangular tray 20 equipped with an adjustable neck strap 40 engaging the rear neck of the user 100 having a plurality of adjusting apertures 42 to allow for length and angle adjustment. The apparatus 10 is envisioned to be particularly useful for activities such as, but not limited to: eating while in a motor vehicle, for use by convalescing patients, eating while in bed, and the like.

Referring now to FIG. 1, a perspective view of the apparatus 10 depicting an in-use state, according to the preferred embodiment of the present invention, is disclosed. The apparatus 10 comprises a rectangular tray 20 approximately sixteen (16) inches wide by twelve (12) inches deep; however, the apparatus 10 may be provided in a variety of width and depth dimensions based upon a size of a user, intended uses, or a user's preference and as such should not be interpreted as a limiting factor of the apparatus 10. The tray 20 is envisioned to be made of easily washable food-grade plastic manufactured in an injection-molding process. The tray 20 further comprises an upwardly extending lip 24 approximately one-eighth (⅛) to one-quarter (¼) of an inch high and one (1) inch wide located therearound an entire perimeter edge to prevent liquid spills or loss of crumbs therefrom.

The short side edge portions of the tray 20 provide attachment of an adjustable neck strap 40 which goes up and around the rear neck area of the user 100 and attaches to the opposite side of the tray 20. The neck strap 40 comprises a "U"-shape flexible plastic strap member approximately one (1) inch wide. The adjustable strap 40 further comprises a plurality of equally-spaced apertures 42 approximately one-quarter (¼) inch in diameter being located adjacent thereto end portions, thereby allowing for length and angle adjustment. The apertures 42 allow connection of the adjustable strap 40 thereto side surfaces of the tray 20 via corresponding integrally molded first connectors 28 located on opposing sides of the tray 40. In such a manner, the apparatus 10 can be easily resized to suit various users 100 including large adults to small children. The adjustable strap 40 is envisioned to be molded or extruded having various colors and patterns based upon a user's 100 preference or may be introduced in transparent, translucent, or opaque plastic materials. Additionally, each end portion of the neck strap 40 provides attachment of an angled fixed length strap 80 which helps to keep the tray 20 level and prevent movement during use (see FIG. 2).

Figure 2:
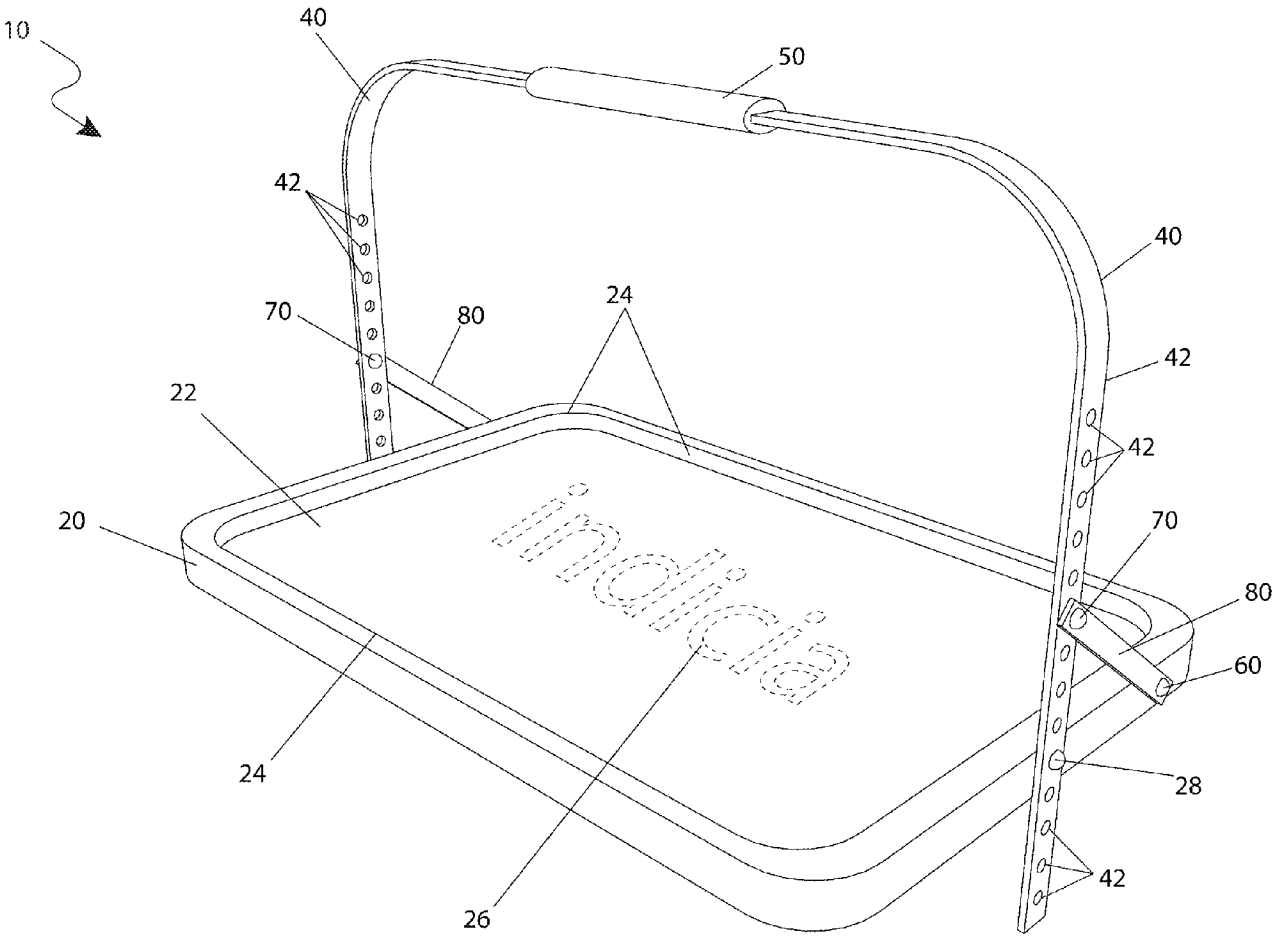
FIG. 2 is a close-up perspective view of the personal eating tray 10, according to a preferred embodiment of the present invention.

Referring now to FIG. 2, a close-up perspective view of the apparatus 10, according to the preferred embodiment of the present invention, is disclosed. The apparatus 10 comprises indicia 26, a neck pad 50, and a pair of fixed length straps 80. The tray portion 20 of the apparatus 10 provides an attachment means thereto the adjustable neck strap 40 and the fixed length strap 80 via respective integrally-molded first connectors 28 arranged along opposing side surfaces at intermediate and rear positions allowing various configurations of the apparatus 10, thereby providing a height adjusting means and a leveling means of the apparatus 10 along a user's 100 chest and neck areas. Said first connectors 28 comprise latching appendages to secure the adjustable strap 40 thereto the tray 20 (see FIG. 3*a*).

The tray 20 also comprises various indicia 26 being molded or painted thereonto a top surface of said tray 20 and are envisioned to provide script or logos based upon a user's preference and may include images such as, but not limited to: sports names/logos, personal names, symbols, pictures, and the like to further customize and personalize the apparatus 10. Said indicia 26 may further comprise a variety of corresponding colors and patterns.

The adjustable strap 40 further comprises a neck pad 50 providing a comfortable surface with which said strap 40 may contact a user's 100 neck when utilizing the apparatus 10. The neck pad 50 is positioned along the adjustable strap 40 thereat an intermediate location encompassing a length of the adjustable strap 40 approximately twelve (12) inches long. The neck pad 50 comprises a generally cylindrical-shaped portion of polyurethane foam having a smooth plastic covering being suitable for easy washing. The neck pad 50 is envisioned to be laterally stationary and affixed thereto said adjustable strap 40 using common methods such as adhesive bonding, welding, or sewing.

Each fixed length strap 80 is removably attached thereto the tray 20 and the adjustable strap 40 using first 28, second 60, and third 70 connectors. Said fixed length strap 80 secures the adjustable strap 40 thereat a particular angle with regards thereto the tray 20, thereby enabling the tray 20 to be retained thereat a level or slightly angled attitude to minimize spills. Each fixed length strap 80 comprises a strap aperture 42 at each end portion enabling insertion of the aforementioned second 60 and third 70 connectors (see FIGS. 3*a* and 3*b*). The fixed length straps 80 are envisioned to be made using similar flexible plastic materials as the adjustable strap 40.

Figure 3A:
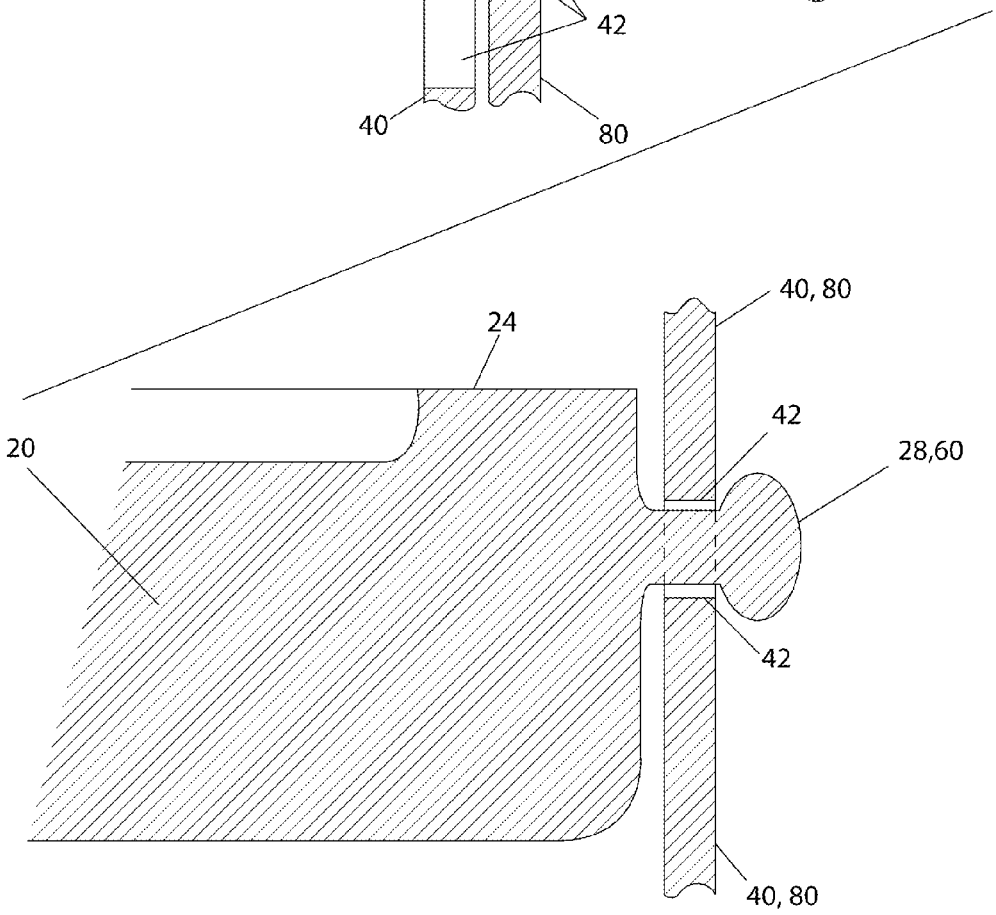

Referring now to FIG. 3*a*, a close-up view of first 28 and second 60 connector portions of the apparatus 10, according to a preferred embodiment of the present invention, is disclosed. The first 28 and second 60 connectors comprise linear protruding fastening means being integral thereto the tray 20 comprising a ball-end fastening feature having a particular diameter so as to provide an interference fit when inserted therethrough aperture portions 42 of the adjustable 40 and fixed length 80 straps, thereby retaining said straps 40, 80 in position. It is further understood that various adjustable fastening means to secure said adjustable 40 and fixed length 80 straps thereto the tray 20 may be utilized such as, but not limited to: spring pins, buckles, snaps, quick-release pins, or the like, without deviating from the concept and as such should not be interpreted as a limiting factor of the apparatus 10.

Referring now to FIG. 3*b*, a close-up view of a third connector portion 70 of the apparatus 10, according to a preferred embodiment of the present invention, is disclosed. The third connector 70 comprises a dog bone-shaped fastener being utilized to affix the fixed length strap 80 thereat multiple positions therealong said adjustable strap 40 using the plurality of apertures 42 as previously described. Said third connector 70 comprises a ball-end feature thereat each end portion in a similar manner as the aforementioned first 28 and second 60 connectors, thereby securing said aperture portions 42 thereonto.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of configuring and utilizing the apparatus 10 may be achieved by performing the following steps: procuring a particular model of the apparatus 10 having a desirable indicia 26, color, and width and depth tray 20, based upon intended usage, size of the user 100, and personal preferences; inserting the first connector 28 therethrough an aperture portion 42 of the adjustable strap 40; wrapping said adjustable strap 40 therearound a rear portion of one's neck; connecting the remaining loose end portion of the adjustable strap 40 thereto the opposing first connector 28, or if already fastened and adjusted thereto an anticipated user 100, inserting a head portion of a user 100 therethrough the adjustable strap portion 40; centering the neck pad portion 50 of the adjustable strap 40 thereagainst a rear portion of the user's 100 neck; adjusting a height characteristic of the apparatus 10, if needed, by affixing different aperture portions 42 of the adjustable strap 40 thereto the first 28 and third 70 connectors in a trial-and-error manner until obtaining a desired height; adjusting a front-to-back angular characteristic of the tray 20 thereinto a desired level or slightly angled position by selecting a relative position of the adjustable strap 40 and the fixed length strap 80 using the third connector 70 and the apertures 42 in a trial-and-error manner until obtaining desired results; placing various items thereupon the tray 20 such as food, drinks, personal care items, and the like, as desired; containing said items thereupon the tray 20 using the retaining nature of the lip portion 24 of the tray 20; performing normal eating and drinking activities while seated, reclining in a bed, traveling in a motor vehicle, or the like; and, benefiting from the adjustability and versatility of the apparatus 10 as well as improved containment of crumbs, drink spills, and the like, while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tray assembly for support on a user, comprising:

a tray member; and, an adjustable strap assembly for suspending said tray member from said user, removably attachable to said tray member;

wherein said adjustable strap assembly further comprises a length adjustment means and an angle adjustment means;

wherein said tray member further comprises: a generally rectangular resilient body having a pair of longitudinal side walls, a pair of lateral side walls, and a tray surface, wherein said pair of longitudinal side walls and said pair of lateral side walls form an upwardly extending lip disposed about an entire perimeter edge of said tray surface; a pair of first connectors integrally formed on opposing outer surfaces of said pair of longitudinal side walls; and, a pair of second connectors integrally formed on opposing outer surfaces of said pair of longitudinal side walls adjacent to said pair of first connectors;

wherein said tray member comprises a material or a set of materials suitable for placing and eating foodstuffs;

wherein said lip provides a retention means for items stored or dropped on said body;

wherein said adjustable strap assembly further comprises: a "U"-shape flexible strap member; a plurality of equally-spaced apertures located on a first surface at each opposing ends of said strap member; and, a pair of fixed length straps each attached at a first aperture located at a first end to one of said pair of second connectors and at a second aperture located at a second end to one of said plurality of apertures with one of a pair of third connectors;

wherein one of said plurality of apertures at each end of said strap correspondingly engages said pair of first connectors to removably attach said adjustable strap assembly to said tray assembly;

wherein said placement of said one of said plurality of apertures of each side of said strap member onto said pair of first connectors provides said length adjustment means;

and, wherein said placement of said one of said plurality of apertures of each side of said strap member onto said pair of fixed length straps and securement with said pair of third connectors provides said angle adjustment means to level said tray member with respect to said user.

2. The tray assembly of claim 1, wherein said tray member is adapted to be suspended from a neck of said user.

3. The tray assembly of claim 1, wherein said tray member comprises dimensions of approximately sixteen inches in width and twelve inches in depth.

4. The tray assembly of claim 1, wherein said lip extends approximately one-eighth to one-quarter in height and one inch in width.

5. The tray assembly of claim 1, wherein said pair of third connectors each further comprise a fastener having a ball-end feature at each end.

6. A tray assembly for support on a user, comprising:

a tray member;

an adjustable strap assembly for suspending said tray member from said user, removably attachable to said tray member; and, a pad encompassing a portion of said adjustable strap assembly;

wherein said adjustable strap assembly further comprises a length adjustment means and an angle adjustment means;

wherein said tray member further comprises: a generally rectangular resilient body having a pair of longitudinal side walls, a pair of lateral side walls, and a tray surface, wherein said pair of longitudinal side walls and said pair of lateral side walls form an upwardly extending lip disposed about an entire perimeter edge of said tray surface; a pair of first connectors integrally formed on opposing outer surfaces of said pair of longitudinal side walls; and, a pair of second connectors integrally formed on opposing outer surfaces of said pair of longitudinal side walls adjacent to said pair of first connectors;

wherein said tray member comprises a material or a set of materials suitable for placing and eating foodstuffs;

wherein said lip provides a retention means for items stored or dropped on said body;

wherein said adjustable strap assembly further comprises: a "U"-shape flexible strap member; a plurality of equally-spaced apertures located on a first surface at each opposing ends of said strap member; and, a pair of fixed length straps each attached at a first aperture located at a first end to one of said pair of second connectors and at a second aperture located at a second end to one of said plurality of apertures with one of a pair of third connectors;

wherein one of said plurality of apertures at each end of said strap correspondingly engages said pair of first connectors to removably attach said adjustable strap assembly to said tray assembly;

wherein said placement of said one of said plurality of apertures of each side of said strap member onto said pair of first connectors provides said length adjustment means;

and, wherein said placement of said one of said plurality of apertures of each side of said strap member onto said pair of fixed length straps and securement with said pair of third connectors provides said angle adjustment means to level said tray member with respect to said user.

7. The tray assembly of claim 6, wherein said tray member is adapted to be suspended from a neck of said user.

8. The tray assembly of claim 6, wherein said tray member comprises dimensions of approximately sixteen inches in width and twelve inches in depth.

9. The tray assembly of claim 6, wherein said lip extends approximately one-eighth to one-quarter in height and one inch in width.

10. The tray assembly of claim 6, wherein said pair of third connectors each further comprise a fastener having a ball-end feature at each end.

11. The tray assembly of claim 6, wherein said pad further comprises a generally cylindrical-shaped portion of polyurethane foam having a washable covering.

12. The tray assembly of claim 11, wherein said pad is adjustably positioned upon said adjustable strap assembly.

13. The tray assembly of claim 11, wherein said pad is affixed at a central location to said adjustable strap assembly.

14. A method of utilizing a tray assembly suspended from a neck of user comprises the following steps:

providing said tray assembly, further comprising:

a tray member, further comprising:

a generally rectangular resilient body having a pair of longitudinal side walls, a pair of lateral side walls, and a tray surface, wherein said pair of longitudinal side walls and said pair of lateral side walls form an upwardly extending lip disposed about an entire perimeter edge of said tray surface;

a pair of first connectors integrally formed on opposing outer surfaces of said pair of longitudinal side walls; and, a pair of second connectors integrally formed on opposing outer surfaces of said pair of longitudinal side walls adjacent to said pair of first connectors;

an adjustable strap assembly, further comprising:

a "U"-shape flexible strap member;

a plurality of equally-spaced apertures located on a first surface at each opposing ends of said strap member; and, a pair of fixed length straps each comprising a first aperture located at a first end and a second aperture located at a second end;

a pair of third connectors; and, a pad encompassing a portion of said adjustable strap assembly, further comprising a generally cylindrical-shaped portion of polyurethane foam with a covering;

placing said strap member around said neck;

determining a desired length for said tray member;

fastening one of said plurality of apertures of each side of said strap member corresponding to said desired length to each of said pair of first connectors;

fastening said first aperture of each of said pair of fixed length straps to each of said pair of second connectors;

determining a desired angle for said tray member;

fastening one of said plurality of apertures of each side of said strap member corresponding to said desired angle to said second aperture of each of said pair of fixed length straps with said pair of third connectors; and, utilizing said tray assembly as desired.

15. The method of claim 14, further comprising the step of:

affixing said pad to a central located about said adjustable strap assembly.

16. The method of claim 14, further comprising the step of:

adjusting said pad to a desired location about said adjustable strap assembly.

* * * * *